US009329506B2

(12) United States Patent
Wu

(10) Patent No.: US 9,329,506 B2
(45) **Date of Patent: *May 3, 2016**

(54) ALCOHOL PHOSPHATE TREATED CARBON BLACK COMPOSITIONS

(71) Applicant: Xerox Corporation, Norwalk, CT (US)

(72) Inventor: Jin Wu, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 141 days.

This patent is subject to a terminal disclaimer.

(21) Appl. No.: 14/206,288

(22) Filed: Mar. 12, 2014

(65) Prior Publication Data

US 2015/0261108 A1 Sep. 17, 2015

(51) Int. Cl.
*G03G 7/00* (2006.01)
*H01B 1/24* (2006.01)

(52) U.S. Cl.
CPC ..... *G03G 7/0053* (2013.01); *H01B 1/24* (2013.01)

(58) Field of Classification Search
CPC ..... G03G 7/0053; G03G 15/206; G03G 2215/2032; G03G 15/20; G03G 7/00; H01B 1/12
USPC ..... 252/500; 399/333
See application file for complete search history.

(56) References Cited

U.S. PATENT DOCUMENTS

| | | | | |
|---|---|---|---|---|
| 5,487,707 | A | 1/1996 | Sharf et al. | |
| 6,072,976 | A * | 6/2000 | Kuriyama | G03G 15/162 399/302 |
| 6,139,784 | A | 10/2000 | Oshima et al. | |
| 6,318,223 | B1 | 11/2001 | Yu et al. | |
| 6,397,034 | B1 | 5/2002 | Tarnawskyj et al. | |
| 6,440,515 | B1 | 8/2002 | Thornton et al. | |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 2013/0011651 | A1 * | 1/2013 | Iizumi | B29C 41/24 428/220 |

* cited by examiner

*Primary Examiner* — Mark Kopec
*Assistant Examiner* — Danny N Kang
(74) *Attorney, Agent, or Firm* — Eugene O. Palazzo

(57) ABSTRACT

An intermediate transfer member that contains a composition of an alcohol phosphate and carbon black, and where there is formed a chemical attachment between the carbon black and the alcohol phosphate, and processes thereof.

14 Claims, 1 Drawing Sheet

ALCOHOL PHOSPHATE TREATED CARBON BLACK COMPOSITIONS

This disclosure is generally directed to compositions comprised of alcohol phosphate treated carbon blacks, and more specifically, there are disclosed herein compositions comprised of carbon black with at least one chemically bonded alcohol phosphate and a polymer, processes of preparation thereof, and intermediate transfer members thereof.

BACKGROUND

Certain carbon black and carbon black containing mixtures are known. Also known are specific mixtures of carbon blacks generated with a polyethylene glycol with a weight average molecular weight of from about 1,000 to about 1,000,000. Disadvantages associated with the aforementioned carbon black mixtures relate to the difficulties in effectively and economically suitably dispersing the carbon black in polymer containing substances.

Further, a vast number of carbon blacks are known that have certain different characteristics, such as surface areas, sizes, surface substances, conductivities, and how the carbon blacks are prepared like, for example, in furnaces heated to high temperatures. These carbon blacks are usually not easily dispersible in polymers, and in some instances dispersions of these carbon blacks in polymers are not readily achievable.

The surface chemistry of carbon blacks is dependent, for example, on the production process that is selected. With the furnace black process, carbon black formation takes place in a highly reducing atmosphere, while with gas carbon black processes atmospheric oxygen has free access to the carbon black formation zone. Accordingly, the gas produced carbon blacks have a considerably higher content of surface oxides immediately after production than do furnace blacks.

Additionally known are the uses of specific carbon blacks in paints, toners, ink jet inks, rubbers, plastics, photoconductors, and intermediate transfer members. Thus, carbon black containing intermediate transfer members, such as intermediate transfer belts selected for transferring a developed image in xerographic systems, are known, see, for example, U.S. Pat. Nos. 8,545,989; 8,501,322; 8,465,839 and 8,361,624, the disclosures of which are all hereby totally incorporated by reference. Also, there is known a number of intermediate transfer members that include materials of a low unacceptable modulus or break strength, poor release characteristics from metal substrates, and which members are costly to prepare primarily because of the cost or scarcity of raw materials and the lengthy drying times. Further known are certain intermediate transfer members with characteristics that cause these members to become brittle resulting in inadequate acceptance of a toner developed image and subsequent partial transfer of the developed xerographic images to a substrate like paper.

A disadvantage relating to the preparation of an intermediate transfer member is that there is usually deposited on a metal substrate a separate release layer, and thereafter, there is applied to the release layer the intermediate transfer member components, and where the release layer allows the resultant intermediate transfer member to be separated from the metal substrate by peeling or by the use of mechanical devices. Thereafter, the intermediate transfer member is in the form of a belt, which can be selected for xerographic imaging systems, or the belt can be deposited on a supporting substrate such as a polymer belt. The use of a release layer adds to the cost and time of preparation, and such a layer can modify a number of the intermediate transfer member characteristics.

There is a need for treated carbon black compositions that substantially avoid or minimize the disadvantages of various known carbon blacks.

Further, there is a need for carbon blacks that can be fully, for example, from about 95 to about 100 percent, readily dispersed in polymers.

Yet further, there is a need for treated carbon black compositions and methods of preparation thereof, and which compositions can be selected for those situations where excellent polymeric dispersions thereof are desired, and where such carbon blacks can be selected for the preparation of intermediate transfer members.

There is also a need for intermediate transfer members that substantially avoid or minimize the disadvantages of a number of known intermediate transfer members.

Also, there is a need for intermediate transfer members with excellent break strengths as determined by their modulus measurements, which are readily releasable from substrates, and possess high glass transition temperatures, and improved stability with no or minimal degradation for extended time periods.

Moreover, there is a need for intermediate transfer member materials that possess rapid release characteristics from a number of substrates that are selected when such members are prepared.

Yet another need resides in providing surface treated carbon blacks where the amount present of the resulting product can be improved, where coating defects, such as where there is decomposition of the treating agent, especially at temperatures of about 250° C., is minimized or avoided, and intermediate transfer members that can be generated by flow coating processes.

Additionally, there is a need for intermediate transfer members where after the coating of a dispersion containing a treated carbon black followed by curing the resulting cured product self-releases from a coating mandrel or substrate, such as stainless steel or aluminum, and with no coating defects, and where the carbon black loading can be extended from, for example, about 11.3±0.1 weight percent to about 18.5±0.3 weight percent while obtaining an excellent member resistivity, and where (1) there is an absence of free alcohol phosphate in the intermediate transfer member in that all the phosphates are chemically bonded to the carbon black surface, thus minimal coating defects; and (2) the carbon black becomes less conductive, thus extending the carbon black loading range.

Another need relates to providing seamless intermediate transfer members that have excellent conductivity or resistivity, and that possess acceptable humidity insensitivity characteristics leading to developed images with minimal resolution issues.

There is also a need for processes for generating treated carbon black dispersions and coatings for substrates.

Further, there is a need for economical processes where treated carbon blacks are readily dispersible in polymers by the simple mechanical mixing thereof.

These and other needs are achievable in embodiments with the compositions and processes disclosed herein.

SUMMARY

Disclosed is an intermediate transfer member comprising a polyimide and carbon black that includes at least one chemically bonded alcohol phosphate.

Also disclosed is an intermediate transfer member comprising in sequence a supporting substrate, a layer thereover comprised of a mixture of a polyimide and carbon black that includes at least one ionically bonded alcohol phosphate, a polysiloxane, a fluoro polymer, or mixtures thereof, and wherein the alcohol phosphate is represented by the following formula/structure

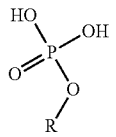

wherein R is a hydrocarbon group.

Further disclosed is a composition comprised of a polymer and a carbon black that includes at least one chemically bonded alcohol phosphate.

FIGURES

The following Figures are provided to further illustrate the intermediate transfer members disclosed herein.

EMBODIMENTS

The terms "including", "includes", "having", "has", "with", or variants thereof are intended to be inclusive in a manner similar to the term "comprising". The term "at least one of" means, for example, that one or more of the listed items can be selected.

Any disclosed numerical value inherently contains certain errors necessarily resulting from the standard deviation found in their respective testing measurements. Moreover, all ranges disclosed herein are to be understood to encompass any and all sub-ranges subsumed therein. For example, a range of from about 1 to about 10 can include any and all sub-ranges there between such as 2, 3, 4, 5, 6, 7, 8, 9, and 10, and about can include ranges below 1 and ranges above 10.

Figure 1:
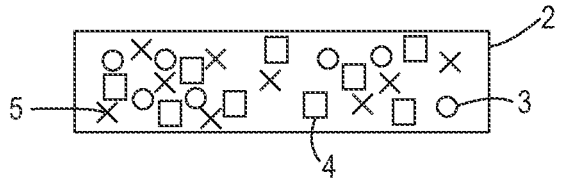
FIG. 1 illustrates an exemplary embodiment of a one-layer intermediate transfer member of the present disclosure.

In FIG. 1, there is illustrated an intermediate transfer member comprising a layer 2 comprised of the disclosed carbon blacks having chemically bonded thereto an alcohol phosphate 3, dispersed in polymers 4, and including optional siloxane polymers, fluoropolymers, or mixtures thereof 5.

Figure 2:
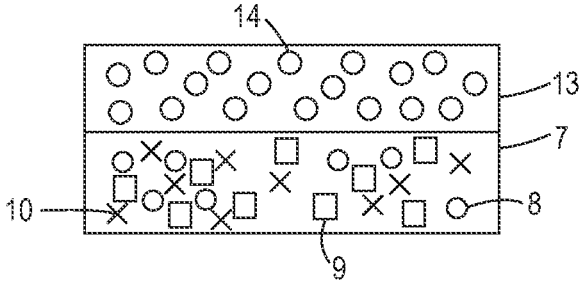
FIG. 2 illustrates an exemplary embodiment of a two-layer intermediate transfer member of the present disclosure.

In FIG. 2, there is illustrated a two-layer intermediate transfer member comprising a bottom layer 7 comprising the disclosed carbon blacks having alcohol phosphates ionically bonded thereto 8, dispersed in polymers 9, optional siloxane polymers, optional fluoropolymers, or mixtures thereof 10, and an optional top or outer toner release layer 13 comprising release components 14.

Figure 3:
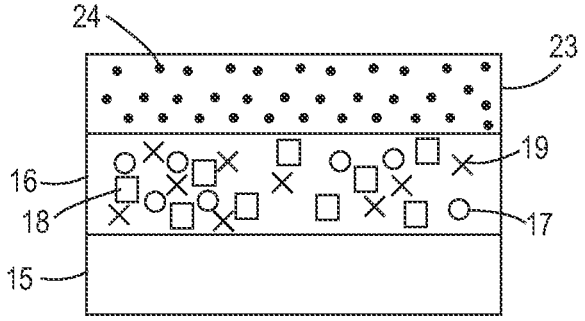
FIG. 3 illustrates an exemplary embodiment of a three-layer intermediate transfer member of the present disclosure.

In FIG. 3, there is illustrated a three-layer intermediate transfer member comprising a supporting substrate 15, a layer thereover 16 comprising carbon blacks having ionically bonded thereto alcohol phosphates 17, polymers 18, optional siloxane polymers or optional fluoropolymers 19, and an optional release layer 23 comprising release components 24.

Alcohol Phosphates

The disclosed compositions and intermediate transfer members thereof are comprised of carbon blacks which have chemically attached, and surface grafted thereon, such as ionically attached to the surface thereof, alcohol phosphates. Examples of alcohol phosphates that are surface grafted, such as being ionically attached to carbon black surfaces, or where there is generated an ionic bond between the carbon black and the alcohol phosphates, which phosphates are obtainable from Stepan Company, are represented by at least one of the phosphates of the following formulas/structures and mixtures thereof $$C_nH_{2n+1}—O—P(=O)(OH)_2$$

and $$C_nH_{2n-1}—O—P(=O)(OH)_2$$

where n represents the number of atoms of carbon and hydrogen, which number is, for example, from about 6 to about 24, from about 7 to about 20, from about 10 to about 18, or from about 8 to about 16. More specifically, examples of alcohol phosphates selected for the disclosed compositions and intermediate transfer members, and which alcohol phosphates are obtainable from Stepan Company, are represented by the formula/structure illustrated herein, such as the following formula/structure

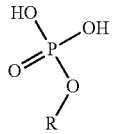

wherein R is a hydrocarbon inclusive of linear, branched, cyclic, saturated and unsaturated hydrocarbons, such as alkyl and alkenyl, each with, for example, from about 6 to about 24 carbon atoms, from about 10 to about 18 carbon atoms, from about 8 to about 16 carbon atoms, from about 8 to about 10 carbon atoms, or from about 12 to about 13 carbon atoms. Examples of the alcohol phosphate hydrocarbon substituents are hexyl, heptyl, octyl, nonyl, decyl, undecyl, dodecyl, icosyl, cyclohexyl, hexenyl, heptenyl, octenyl, nonenyl, decenyl, undecenyl, dodecenyl, icosenyl, the corresponding alkenyls, and the like.

Examples of specific alcohol phosphates selected for the disclosed compositions and intermediate transfer member mixtures, and which alcohol phosphates are obtainable from Stepan Company are represented by the following formulas/structures $C_6H_{13}—O—P(=O)(OH)_2$, $C_6H_{11}—O—P(=O)(OH)_2$, $C_{12}H_{25}—O—P(=O)(OH)_2$, $C_{12}H_{23}—O—P(=O)(OH)_2$, $C_{16}H_{33}—O—P(=O)(OH)_2$, $C_{16}H_{31}—O—P(=O)(OH)_2$, $C_{13}H_{27}—O—P(=O)(OH)_2$, $C_{18}H_{35}—O—P(=O)(OH)_2$, $C_{8\text{-}10}H_{17\text{-}21}—O—P(=O)(OH)_2$, a mixture of $C_8H_{17}—O—P(=O)(OH)_2/C_{10}H_{21}—O—P(=O)(OH)_2$, and mixtures thereof.

Various ratios and amounts of the alcohol phosphate treated carbon black can be selected for the disclosed compositions and the intermediate transfer members thereof, such as for example, where the weight ratio of the alcohol phosphate treated carbon black/polyamic acid, and where the weight ratio of the alcohol phosphate treated carbon black/polyimide/fluoropolymer is about 18/81/1, about 18.5/81.3/0.2, about 19/80/1, about 17/82/1, about 18.7/81/0.3, or about 20/79.9/0.1.

One specific disclosed composition and intermediate transfer member thereof comprises a mixture of a polyimide of biphenyl tetracarboxylic dianhydride/phenylenediamine, the disclosed alcohol phosphate treated carbon black and a fluoropolymer, prepared as illustrated herein, about 16 to about 20 percent by weight of solids, and where the disclosed polyimide, alcohol phosphate treated carbon black, fluoropolymer weight ratio is, for example, 18.5/81.3/0.2.

The disclosed polyimide/alcohol phosphate treated carbon black composition possesses, for example, a Young's modulus of from about 4,000 to about 10,000 MPa, from about 5,000 to about 9,500 MPa, and from about 6,500 MPa to about 8,500 MPa.

The disclosed alcohol phosphate treated carbon black can include various amounts of the alcohol phosphates and the carbon black, thus for example, from about 40 to about 99 or from about 70 to about 95 weight percent of the carbon blacks are present and from about 1 to about 60 or from about 5 to about 30 weight percent of the alcohol phosphates are present based on the solids, and where the total thereof is about 100 percent. The alcohol phosphate that includes at least one carbon black chemically bonded alcohol phosphate, and which bonded alcohol phosphate is present in an amount of, for example, from about 0.1 to about 20 weight percent of total solids, and wherein the chemically bonded is ionic, or wherein the alcohol phosphate that includes at least one carbon black chemically bonded thereto is present in an amount of from about 0.5 to about 10 weight percent of total solids.

Carbon Blacks

Numerous known carbon blacks can be selected for the compositions, members, and processes disclosed herein. Representative examples of carbon blacks include various carbon blacks, such as channel blacks, furnace blacks and lamp blacks, and more specifically, carbon blacks available as REGAL® carbon blacks, BLACK PEARLS®, such as BLACK PEARLS® 2000, BLACK PEARLS® 1400, BLACK PEARLS® 1300, BLACK PEARLS® 1100, BLACK PEARLS® 1000, BLACK PEARLS® 900, BLACK PEARLS® 880, BLACK PEARLS® 800, BLACK PEARLS® 700, VULCAN® Black 4, Special Black 5, FW200, RAVEN® 780, RAVEN® 890, RAVEN® 1020, RAVEN® 1040, RAVEN® 1255, RAVEN® 1500, RAVEN® 5000, RAVEN® 5250, mixtures thereof, and the like.

Specific examples of carbon blacks selected for the compositions and processes of the present disclosure include Special Black 4 (B.E.T. surface area=180 $m^2/g$, DBP absorption=1.8 ml/g, primary particle diameter=25 nanometers) available from Evonik-Degussa, Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), Color Black FW200 (B.E.T. surface area=460 $m^2/g$, DBP absorption=4.6 ml/g, primary particle diameter=13 nanometers), all available from Evonik-Degussa; VULCAN® carbon blacks, REGAL® carbon blacks, MONARCH® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), 880 (B.E.T. surface area=240 $m^2/g$, DBP absorption=1.06 ml/g), 800 (B.E.T. surface area=230 $m^2/g$, DBP absorption=0.68 ml/g), L (B.E.T. surface area=138 $m^2/g$, DBP absorption=0.61 ml/g), 570 (B.E.T. surface area=110 $m^2/g$, DBP absorption=1.14 ml/g), 170 (B.E.T. surface area=35 $m^2/g$, DBP absorption=1.22 ml/g), VULCAN® XC72 (B.E.T. surface area=254 $m^2/g$, DBP absorption=1.76 ml/g), XC72R (fluffy form of VULCAN® XC72), XC605, XC305, REGAL® 660 (B.E.T. surface area=112 $m^2/g$, DBP absorption=0.59 ml/g), 400 (B.E.T. surface area=96 $m^2/g$, DBP absorption=0.69 ml/g), 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and 1000 (B.E.T. surface area=343 $m^2/g$, DBP absorption=1.05 ml/g, primary particle diameter=16 nanometers); Channel Special Carbon Black 4 and Channel Special Carbon Black 5 available from Orion, and Channel Special Carbon Black available from Evonik-Degussa.

Polyimides

The treated chemically bonded carbon black compositions illustrated herein can be effectively dispersed, such as in an amount of from about 80 to about 100 percent, or from about 85 to about 100 percent, in a number of known polymers, and more specifically, in polyimides thereby forming intermediate transfer members, which compositions self-release from a metal substrate, such as stainless steel.

Examples of polyimides selected for the members illustrated herein can be formed from a polyimide precursor of a polyamic acid that includes one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like, and mixtures thereof. After curing, the resulting polyimides include a polyimide of pyromellitic dianhydride/4,4'-oxydianiline, a polyimide of pyromellitic dianhydride/phenylenediamine, a polyimide of biphenyl tetracarboxylic dianhydride/4,4'-oxydianiline, a polyimide of biphenyl tetracarboxylic dianhydride/phenylenediamine, a polyimide of benzophenone tetracarboxylic dianhydride/4,4'-oxydianiline, a polyimide of benzophenone tetracarboxylic dianhydride/4,4'-oxydianiline/phenylenediamine, and mixtures thereof.

Commercially available examples of polyamic acid of pyromellitic dianhydride/4,4'-oxydianiline selected include PYRE-ML RC5019 (about 15 to 16 weight percent in N-ethyl-2-pyrrolidone, NMP), RC5057 (about 14.5 to 15.5 weight percent in NMP/aromatic hydrocarbon=80/20), and RC5083 (about 18 to 19 weight percent in NMP/DMAc=15/85), all from Industrial Summit technology Corp., Parlin, N.J.; DURIMIDE® 100, commercially available from FUJIFILM Electronic Materials U.S.A., Inc.

For the generation of the polyimides selected for the intermediate transfer members illustrated herein, there can be utilized polyamic acids of biphenyl tetracarboxylic dianhydride/phenylenediamine including U-VARNISH A, and S (about 20 weight in NMP), both available from UBE America Inc., New York, N.Y., PI-2610 (about 10.5 weight in NMP), and PI-2611 (about 13.5 weight in NMP), both available from HD MicroSystems, Parlin, N.J., BPDA resin (about 16.8 weight percent in NMP), available from Kaneka Corporation, and TX, PI-2610 (about 10.5 weight percent in NMP), and PI-2611 (about 13.5 weight percent in NMP), both available from HD MicroSystems, Parlin, N.J.

Commercially available examples of polyamic acids of benzophenone tetracarboxylic dianhydride/4,4'-oxydianiline include RP46 and RP50 (about 18 weight percent in NMP), both available from Unitech Corp., Hampton, Va.; while commercially available examples of polyamic acids of benzophenone tetracarboxylic dianhydride/4,4'-oxydianiline/phenylenediamine include PI-2525 (about 25 weight percent in NMP), PI-2574 (about 25 weight percent in NMP), PI-2555 (about 19 weight percent in NMP/aromatic hydrocarbon=80/20), and PI-2556 (about 15 weight percent in NMP/aromatic hydrocarbon/propylene glycol methyl ether=70/15/15), all available from HD MicroSystems, Parlin, N.J.

More specifically, polyamic acid or esters of polyamic acid examples that can be selected for the formation of a polyimide are prepared by the reaction of a dianhydride and a diamine. Suitable dianhydrides selected include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl)hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxyl)phenyl)ether dianhydride, di-(4-(3,4-dicarboxyphenoxyl)phenyl) sulfide dianhydride, di-(3,4-dicarboxyphenyl)methane dianhydride, di-(3,4-dicarboxyphenyl) ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy)diphthalic dianhydride, 4,4'-diphenylsulfidedioxybis(4-phthalic acid) dianhydride, 4,4'-diphenylsulfonedioxybis(4-phthalic acid) dianhydride, methylenebis(4-phenyleneoxy-4-phthalic acid) dianhydride, ethylidenebis(4-phenyleneoxy-4-phthalic acid) dianhydride, isopropylidenebis(4-phenyleneoxy-4-phthalic acid)dianhydride, hexafluoroisopropylidenebis(4-phenyleneoxy-4-phthalic acid)dianhydride, and the like.

Exemplary diamines selected suitable for use in the preparation of the polyamic acid include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluorobiphenyl, 4,4'-diamino-2,2',3,3',5,5',6,6'-octafluorodiphenyl ether, bis[4-(3-aminophenoxy)-phenyl]sulfide, bis[4-(3-aminophenoxyl)phenyl]sulfone, bis[4-(3-aminophenoxyl)phenyl]ketone, 4,4'-bis(3-aminophenoxy)biphenyl, 2,2-bis[4-(3-aminophenoxyl)phenyl]-propane, 2,2-bis[4-(3-aminophenoxyl)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, and 2,2-di(p-aminophenyl)-1,1,1,3,3,3-hexafluoropropane, and the like, and mixtures thereof.

The dianhydrides and diamines are, for example, selected in a weight ratio of from about 20:80 to about 80:20, and more specifically, in an about 50:50 weight ratio. The above aromatic dianhydride like aromatic tetracarboxylic acid dianhydrides, and diamines like aromatic diamines are used singly or as a mixture, respectively.

Polyimide examples selected for the member compositions are, for example, represented by at least one of the following formulas/structures, and mixtures thereof

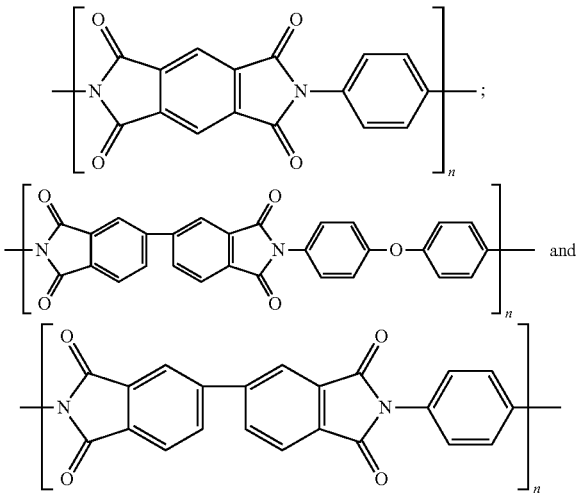

where n represents the number of repeating segments of, for example, from about 5 to about 3,000, from about 50 to about 2,000, from about 50 to about 1,500, from about 200 to about 1,200, from about 1,000 to about 2,000, from about 1,200 to about 1,800, from about 20 to about 200, or from about 20 to about 30.

Examples of polyamic acids of benzophenone tetracarboxylic dianhydride/4,4'-oxydianiline include RP46 and RP50 (about 18 weight percent in NMP), both available from Unitech Corp., Hampton, Va.

Polyamic acids of benzophenone tetracarboxylic dianhydride/4,4'-oxydianiline/phenylenediamine examples are PI-2525 (about 25 weight percent in NMP), PI-2574 (about 25 weight percent in NMP), PI-2555 (about 19 weight percent in NMP/aromatic hydrocarbon=80/20), and PI-2556 (about 15 weight percent in NMP/aromatic hydrocarbon/propylene glycol methyl ether=70/15/15), all available from HD MicroSystems, Parlin, N.J.

After curing by heating, the resulting polyimides include, for example, a polyimide of pyromellitic dianhydride/4,4'-oxydianiline, a polyimide of pyromellitic dianhydride/phenylenediamine, a polyimide of biphenyl tetracarboxylic dianhydride/4,4'-oxydianiline, a polyimide of biphenyl tetracarboxylic dianhydride/phenylenediamine, a polyimide of benzophenone tetracarboxylic dianhydride/4,4'-oxydianiline, a polyimide of benzophenone tetracarboxylic dianhydride/4,4'-oxydianiline/phenylenediamine, and mixtures thereof.

Optional Leveling Agents

Optional leveling agent examples, which can contribute to the smoothness characteristics, such as enabling smooth coating surfaces with minimal or no blemishes or protrusions, of the members illustrated herein include silicones, such as epoxy-modified silicones (dual-end type), X-22-163C with a reported functional group equivalent weight of 2,700 g/mol, available from Shin-Etsu Silicones; polysiloxane polymers, fluoropolymers, or mixtures thereof.

The optional polysiloxane polymers include, for example, a polyester modified polydimethylsiloxane with the trade name of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane with the trade name of BYK® 333, BYK® 330 (about 51 weight percent in methoxypropylacetate) and BYK® 344 (about 52.3 weight percent in xylene/isobutanol=80/20), BYK®-SILCLEAN 3710 and 3720 (about 25 weight percent in methoxypropanol); a polyacrylate modified polydimethylsiloxane with the trade name of BYK®-SILCLEAN 3700 (about 25 weight percent in methoxypropylacetate); or a polyester polyether modified polydimethylsiloxane with the trade name of BYK® 375 (about 25 weight percent in di-propylene glycol monomethyl ether), all commercially available from BYK Chemical.

The polysiloxane polymer, or copolymers thereof can be included in the disclosed coating compositions and intermediate transfer members thereof in an amount of, for example, from about 0.1 to about 10 weight percent, from about 0.01 to about 1 weight percent, from about 0.05 to about 1 weight percent, from about 0.05 to about 0.5 weight percent, from about 0.1 to about 0.5 weight percent, from about 0.2 to about 0.5 weight percent, or from about 0.1 to about 0.3 weight percent based on the total weight of the solid components or ingredients present.

Examples of fluoropolymer leveling agents or additives components selected for the disclosed compositions and intermediate transfer members containing such compositions include NOVEC™ FC-4430, 4432 and 4434, NOVEC™ being a registered trademark of 3M Company. The fluoropolymers are selected in various effective amounts, such as for example, from about 0.01 to about 5 weight percent, from about 0.1 to about 3 weight percent, and from about 0.2 to about 1 weight percent based on the solids present.

Solvents

Examples of solvents selected for the compositions and processes illustrated herein are toluene, hexane, cyclohexane, heptane, tetrahydrofuran, methyl ethyl ketone, methyl isobutyl ketone, N,N'-dimethylformamide, N,N'-dimethylacetamide, N-methyl pyrrolidone (NMP), methylene chloride, and mixtures thereof, and where the solvent is selected in, for example, an amount of from about 40 weight percent to about 95 weight percent, or from about 50 weight percent to about 75 weight percent based on the amount of total solids present.

The disclosed polyimide and the treated carbon black ionically bonded to an alcohol phosphate possess, for example, a Young's modulus of from about 4,000 to about 10,000 Mega Pascals (MPa), from about 5,000 to about 10,000 MPa, from about 6,500 to about 7,500 MPa, from about 6,000 to about 10,000 MPa, from about 7,800 to about 7,900 MPa, or from about 7,500 to about 8,000 MPa; a break strength of, for example, from about 190 to about 230 MPa, or from about 195 to about 200 MPa. More specifically, a Young's modulus of about 8,000 MPa and a break strength of about 300 MPa, or a Young's modulus of about 8,500 MPa and a break strength of about 270 MPa.

Optional Supporting Substrates

If desired, a supporting substrate can be included in the disclosed intermediate transfer members, such as beneath the disclosed treated carbon black containing mixture layer. The optional supporting substrate can be formed in various shapes, such as a belt, or a film using suitable materials that are non-conductive or conductive, and where the supporting substrate when included can provide increased rigidity or strength to the intermediate transfer member or to other members.

Exemplary supporting substrate materials include polymers, such as polyimides, polyamideimides, polyetherimides, metals like aluminum, mixtures thereof, and the like.

More specifically, examples of the intermediate transfer member supporting substrates include polyimides inclusive of known low temperature, and rapidly cured polyimide polymers, such as VTEC™ PI 1388, 080-051, 851, 302, 203, 201, and PETI-5, all available from Richard Blaine International, Incorporated, Reading, Pa., polyamideimides, polyetherimides, and the like. The thermosetting polyimides can be cured at temperatures of from about 180° C. to about 260° C. over a short period of time, such as from about 10 to about 120 minutes, or from about 20 to about 60 minutes, and generally have a number average molecular weight of from about 5,000 to about 500,000 or from about 10,000 to about 100,000, and a weight average molecular weight of from about 50,000 to about 5,000,000, or from about 100,000 to about 1,000,000. Also, for the supporting substrate there can be selected thermosetting polyimides that can be cured at temperatures of above 300° C., such as PYRE M.L.® RC-5019, RC 5057, RC-5069, RC-5097, RC-5053, and RK-692, all commercially available from Industrial Summit Technology Corporation, Parlin, N.J.; RP-46 and RP-50, both commercially available from Unitech LLC, Hampton, Va.; DURIMIDE® 100, commercially available from FUJIFILM Electronic Materials U.S.A., Inc., North Kingstown, R.I.; and KAPTON® HN, VN and FN, all commercially available from E.I. DuPont, Wilmington, Del.

Examples of polyamideimides that can be selected as supporting substrates for the intermediate transfer members disclosed herein are VYLOMAX® HR-11NN (15 weight percent solution in N-methylpyrrolidone, $T_g$=300° C., and $M_w$=45,000), HR-12N2 (30 weight percent solution in N-methylpyrrolidone/xylene/methyl ethyl ketone=50/35/15, $T_g$=255° C., and $M_w$=8,000), HR-13NX (30 weight percent solution in N-methylpyrrolidone/xylene=67/33, $T_g$=280° C., and $M_w$=10,000), HR-15ET (25 weight percent solution in ethanol/toluene=50/50, $T_g$=260° C., and $M_w$=10,000), HR-16NN (14 weight percent solution in N-methylpyrrolidone, $T_g$=320° C., and $M_w$=100,000), all commercially available from Toyobo Company of Japan, and TORLON® AI-10 ($T_g$=272° C.), commercially available from Solvay Advanced Polymers, LLC, Alpharetta, Ga.

Specific examples of polyetherimide supporting substrates that can be selected for the intermediate transfer members disclosed herein are ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

Once formed, the supporting substrate, and intermediate transfer member can have any desired and suitable thickness, such as for example, from about 10 to about 1,000 microns, from about 100 to about 800 microns, from about 10 to about 300 microns, from about 150 to about 500 microns, from about 50 to about 200 microns, from about 50 to about 150 microns, from about 50 to about 175 microns, from about 75 to about 125 microns, from about 80 to about 105 microns, from about 20 to about 100 microns, from about 25 to about 75 microns, from about 100 to about 125 microns, from about 75 to about 80 microns, or from about 80 to about 90 microns.

Optional Release Layers

When desired, an optional release layer can be included in the intermediate transfer member, such as in the configuration of a layer over the disclosed treated carbon black containing layer. The release layer can be included to assist in providing toner cleaning and additional developed image transfer efficiency from a photoconductor to the intermediate transfer member.

When selected, the release layer can have any desired and suitable thickness. For example, the release layer can have a thickness of from about 1 to about 100 microns, from about 10 to about 75 microns, or from about 20 to about 50 microns.

The optional release layer can comprise TEFLON®dike materials including fluorinated ethylene propylene copolymers (FEP), polytetrafluoroethylene (PTFE), polyfluoroalkoxy polytetrafluoroethylene (PFA TEFLON®), and other TEFLON®-like materials; silicone materials, such as fluorosilicones and silicone rubbers, such as Silicone Rubber 552, available from Sampson Coatings, Richmond, Va., polydimethyl siloxane/dibutyl tin diacetate, 0.45 gram DBTDA per 100 grams polydimethyl siloxane rubber mixture with a molecular weight $M_w$ of approximately 3,500; and fluoroelastomers, such as those available as VITON®, such as copolymers and terpolymers of vinylidenefluoride, hexafluoropropylene, and tetrafluoroethylene, which are known commercially under various designations as VITON® A, E, E60C, E45, E430, B910, GH, B50, and GF. The VITON® designation is a Trademark of E.I. DuPont de Nemours, Inc. Two known fluoroelastomers are comprised of (1) a class of copolymers of vinylidenefluoride, hexafluoropropylene, and tetrafluoroethylene, known commercially as VITON® A; (2) a class of terpolymers of vinylidenefluoride, hexafluoropropylene, and tetrafluoroethylene, known commercially as VITON® B; and (3) a class of tetrapolymers of vinylidenefluoride, hexafluoropropylene, tetrafluoroethylene, and a cure site monomer, such as VITON® GF, having 35 mole percent of vinylidenefluoride, 34 mole percent of hexafluoropropylene, and 29 mole percent of tetrafluoroethylene with 2 percent cure site monomer. The cure site monomers can be selected from those available from E.I. DuPont de Nemours, Inc. such as 4-bromoperfluorobutene-1,1,1-dihydro-4-bromoperfluorobutene-1,3-bromoperfluoropropene-1,1,1-dihydro-3-bromoperfluoropropene-1, or any other suitable, known, commercially available cure site monomers.

Processes

In accordance with the compositions and processes of the present disclosure, ionically bonded or ionic bond means, for example, a type of chemical bond formed through an electrostatic attraction between two oppositely charged ions. Ionic bonds are formed primarily because of the attraction between an atom that has lost one or more electrons (cation) and an atom that has gained one or more electrons (anion). Also, usually ionic compounds have some degree of covalent bonding, or electron sharing, thus the phrase ionically bonded or ionic bond refers to a bond in which the ionic character is greater than the covalent character, that is where, for example, a bond in which a large electronegativity difference exists between the two atoms, causing the bond to be more polar (ionic) than other forms of covalent bonding where electrons are shared more equally. Bonds with partially ionic and partially covalent character have been referred to as polar covalent bonds. Nevertheless, ionic bonding in accordance with the present disclosure is considered to be, for example, a form of non-covalent bonding, and where, for example, for an ionic bond of the present disclosure the respective atoms are bound by attraction of opposite ions, as compared to a covalent bond where atoms are bound by sharing electrons to attain stable electron configurations.

Carbon blacks can be treated in accordance with the present disclosure by bonding thereto an alcohol phosphate, or where there is formed an ionic bond between the carbon black and the phosphate. More specifically, the process of the present disclosure comprises the mixing of carbon blacks and alcohol phosphates, followed by centrifuging to obtain a carbon black/alcohol phosphate wet cake, dispersing the obtained wet cake in a suitable solvent, where when the carbon black is mixed with the alcohol phosphate in the solvent, a chemical, such as an ionic bond forms there between, followed by centrifuging and then vacuum drying of the composition obtained by heating, resulting in at least one chemical bond formed between the carbon black and the alcohol phosphate inclusive of where the alcohol phosphate is and chemically attached to the carbon black. The presence of at least one bond like an ionic bond, such as between the carbon black and the phosphate segments of the alcohol, can be confirmed by X-ray photospectroscopy (XPS) analysis.

In a process embodiment, a carbon black, such as Orion Special Black 4, can be mixed with a polyamic acid, a solvent, such as those illustrated herein, like methylene chloride and the alcohol phosphate ZELEC® UN available from Stepan Company, and for example, of the following formula/structure where R is, for example, an alkyl with from about 8 to about 10 carbon atoms. The mixture resulting can then be ball milled with stainless steel shots grinding media for a suitable period of time, such as from about 15 to about 21 hours, and more specifically, about 18 hours, and then the obtained mixture can be separated from the stainless steel shots grinding media. Thereafter, the mixture can be centrifuged and a carbon black wet cake can result. The obtained wet cake can then be re-dispersed in a solvent, such as methylene chloride, and centrifuged again; followed by two separate times accomplishing the aforementioned re-dispersion and centrifuging. Subsequently, the resulting wet cake can be thermally treated and vacuum dried overnight, about 12 to about 16 hours, to obtain mixtures of the disclosed polyamic acids and the disclosed alcohol phosphate treated carbon blacks, and where the phosphates of the alcohol phosphate are chemically, such as ionically bonded to the carbon black surface

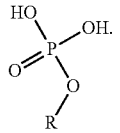

The thermal treatment can be accomplished at various suitable temperatures, such as from about 50° C. to about 95° C., from about 60° C. to about 90° C., from about 70° C. to about 85° C., or from about 75° C. to about 80° C. The centrifuged speed is, for example, from about 1,000 to about 10,000 rpm (revolutions per minute), from about 2,000 to about 8,000 rpm, or from about 3,000 to about 5,000 rpm.

Subsequent to the preparation of the disclosed dispersions, they can be selected for the generation of intermediate transfer members, and where, for example, the dispersions can be applied to a metal substrate, followed by the self release thereof. The self released product obtained can then be selected, for example, as a coating on a supporting substrate. Thus, the disclosed dispersions containing the treated carbon black can be selected as a liquid coating dispersion mixture that can be flow coated on a metal substrate like a stainless steel substrate, aluminum, nickel, copper, and alloys thereof, and glass plates, and subsequently, cured where the polyamic acid converts to a polyimide by heating at, for example, from about 50° C. to about 95° C., or from about 50° C. to about 75° C. for from about 20 to about 50 minutes, or from about 25 to about 35 minutes, followed by heating at from about 175° C. to about 210° C., or from about 180° C. to about 195° C. for from about 20 to about 45 minutes, or from about 25 to about 35 minutes, and then further heating at from about 290° C. to about 340° C., or from about 300° C. to about 325° C. for from about 40 to about 80 minutes, or for from about 50 to about 65 minutes. The resulting film after drying and cooling to room temperature, about 22° C. to about 25° C., is readily releasable without the assistance of any external processes from the metal substrate. That is, the members obtained immediately release, or self-release, such as for example, within from about 1 to about 15 seconds, from about 1 to about 10 seconds, from about 5 to about 15 seconds, from about 5 to about 10 seconds, or about 1 second without any external assistance from the metal substrate, such as a stainless steel substrate. Also, the efficiently and economically formed mixture film will fully separate, such as for example, a separation of from about 90 to about 100 percent, or from about 95 to about 99 percent from metal substrates, and where release materials and separate release layers can be avoided.

With the disclosed processes in embodiments thereof, at least one of the phosphate groups of the alcohol phosphate forms at least one chemical bond, such as an ionic bond with the organic groups on the carbon black surface where the organic groups include, for example, phenolic groups, carboxylic acid groups, mixtures thereof, and the like. Depending, for example, on the carbon black, the type of groups present on the carbon black surface, and the number of groups, there can be formed a plurality of ionic bonds between the carbon black and the alcohol phosphates determined by X-ray photospectroscopy analysis. For example, at least one ionic bond, up to a multiplicity of bonds, is formed between the carbon black and the alcohol phosphate, such as for example, from 1 to about 75, from 1 to about 50, from 1 to about 20, from about 2 to about 50, from about 1 to about 10, from about 1 to about 5, from about 1 to about 2, and more specifically, one single bond, and the like.

The resulting polyimide intermediate transfer member film with a flat configuration, and with no curl, after drying and cooling to room temperature of from about 22° C. to about 25° C., is readily releasable without the assistance of any external processes from metal substrates.

Specific embodiments will now be described in detail. These examples are intended to be illustrative, and not limited to the materials, conditions, or process parameters set forth in these embodiments. All parts are percentages by solid weight unless otherwise indicated.

The Young's Modulus was measured following the known ASTM D882-97 process. Samples (0.5 inch×12 inch) of each intermediate transfer member were placed in a commercially available InstronTensile Tester measurement apparatus, and then the samples were elongated at a constant pull rate until breaking. During this time, there was recorded the resulting load versus the sample elongation. The Young's Modulus value was calculated by taking any point tangential to the initial linear portion of the recorded curve results and dividing the tensile stress by the corresponding strain.

Example I

Ten grams of carbon black (Special Black 4 available from Orion Chemicals) were mixed with 150 grams of methylene chloride solvent and 2 grams of the alcohol phosphate, ZELEC® UN available from Stephan Company, which alcohol phosphate is represented by the following formula/structure

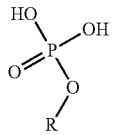

wherein R is alkyl with from about 8 to about 10 carbon atoms, and more specifically, a mixture of $C_8H_{17}$—O—P(=O)$(OH)_2$ and $C_{10}H_{21}$—O—P(=O)$(OH)_2$. The mixture resulting was ball milled with 300 grams of 2 millimeters diameter stainless steel shots for 18 hours, and then the mixture was separated by filtration from the stainless steel shots. Subsequently, the obtained mixture was centrifuged at 3,000 revolutions per minute for 10 minutes resulting in a carbon black/alcohol phosphate wet cake. The wet cake was subsequently re-dispersed in 200 grams of the solvent methylene chloride and then centrifuged twice more to remove the solvent, followed by subjecting the resulting wet cake to the overnight, about 14 hours, thermal treatment and vacuum drying at 80° C. resulting in the phosphates of the alcohol phosphate being ionically bonded to the carbon black, and which ionic bonding was confirmed by X-ray photospectroscopy analysis (XPS).

The obtained alcohol phosphate treated carbon black powder and an untreated carbon black powder were XPS tested for surface element compositions, and the results are show in the following table.

| Special Black 4 Available from Orion Chemicals | Atomic Percent Carbon | Atomic Percent Oxygen | Atomic Percent Phosphorus | Atomic Percent Sulfur |
|---|---|---|---|---|
| Untreated | 91.84 | 8.03 | 0.00 | 0.13 |
| Alcohol Phosphate Treated | 86.23 | 12.39 | 0.98 | 0.09 |

The above 0.98 percent of phosphorus present on the carbon black surface further confirmed the surface treatment and chemical bonding thereof of the carbon black with the alcohol phosphate, and where at least one of the phosphates thereof was bonded to the carbon black surface.

Subsequently, 5 grams of the above obtained alcohol phosphate treated carbon black, with the chemical bonding thereof of the carbon black with the alcohol phosphate, were milled with 129.4 grams of a biphenyl tetracarboxylic dianhydride/phenylenediamine (BPDA) polyamic acid/N-methyl pyrrolidone solution (available from Kaneka, about 16.98 weight percent in N-methyl pyrrolidone, NMP), 0.054 gram of Novec™ FC-4432, a fluoropolymer leveling agent available from 3M Company and 500 grams of 2 millimeter (mm) stainless steel shots which milling was accomplished with an Attritor operating for three hours.

The chemical structure of the polyimide, subsequent to the illustrated herein heated curing of the biphenyl tetracarboxylic dianhydride/phenylenediamine (BPDA) polyamic acid, was as follows

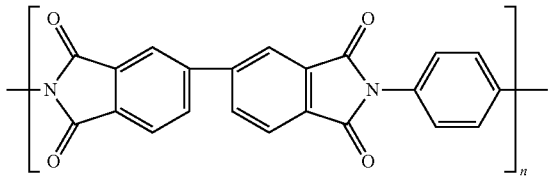

where n is 30.

The resulting alcohol phosphate treated carbon black/polyamic acid/fluoropolymer dispersion, in a weight ratio 18.5/81.3/0.2 NMP, was readily filtered through a 20-micron Nylon cloth filter. The carbon black particle size of this disclosed dispersion was measured at about $10^7$ nanometers (nm) with a very narrow size distribution with both the size and the distribution being determined by a MALVERN HPPS5001 dynamic light scattering instrument.

A number of treated carbon black dispersions were prepared by repeating the above process, and by varying the loading or amount of the carbon black selected to, for example, determine the effect of the carbon black loading on resistivity, and the data obtained is summarized in the following table, and where the controlled or comparative carbon black/alcohol phosphate/polyamic acid/fluoropolymer is in the form of a mixture, where there was no thermal treatment and vacuum drying at 80° C., and where there is an absence of any chemical bonding between the alcohol phosphate and the carbon black. This data shows, for example, that the carbon black loading for the comparative controlled mixture was extended from about 11.3 weight percent to from about 18.2 to about 18.8 weight percent for the surface treated carbon black, and where the resistivity is still within the targeted range of $10^{10}$ ohm/square because of the presence of the surface treatment of the carbon black.

| | Composition | Resistivity (ohm/square) |
|---|---|---|
| The disclosed alcohol phosphate | 18.2/81.6/0.2 | $9.7 \times 10^{10}$ |
| treated carbon black/polyamic | 18.5/81.3/0.2 | $4.5 \times 10^{10}$ |
| acid/fluoropolymer | 18.8/81/0.2 | $1.2 \times 10^{10}$ |
| The controlled carbon black/ | 11.2/0.5/88.1/0.2 | $9.6 \times 10^{10}$ |
| alcohol phosphate/polyamic | 11.3/0.5/88/0.2 | $4.8 \times 10^{10}$ |
| acid/fluoropolymer | 11.4/0.5/87.9/0.2 | $1.3 \times 10^{10}$ |

For the disclosed treated carbon black composition, the untreated carbon black was first mixed with the alcohol phosphate/solvent first, and then separated from the solvent followed by thermal treatment of the resulting product at 80° C., and where ionic bonds are formed between the carbon black and the alcohol phosphate. In contrast, for the above controlled comparative mixture the untreated carbon black was mixed in the solvent, a polyamic acid, and the alcohol phosphate and the fluoropolymer, which prevented the formation of any bonding between the alcohol phosphate and the carbon black, in that the alcohol phosphate was not in close proximity to the carbon black, and also the aforementioned solvent mixture was not subjected to thermal treatment by heating to 80° C.

An intermediate transfer belt was then prepared where the above prepared disclosed alcohol phosphate treated carbon black/polyamic acid dispersion was flow coated on a diamond like carbon coated aluminum cylinder (DLC), and cured at 170° C. for 30 minutes and 320° C. for 2 hours where the polyamic acid converted to the polyimide of the formula/structure depicted above wherein n is equal to 30. The resulting alcohol phosphate treated carbon black/polyimide belt self-released without the assistance of any external processes from the aluminum substrate within 10 seconds, and visually exhibited a very smooth shiny surface with substantially no coating defects, that is no or minimal free alcohol phosphate was present in the intermediate transfer member and all the phosphates were chemically bonded to carbon black surface, the carbon black becomes less conductive, thus extending the carbon black loading range versus coating defects, such as stripes, craters and pinholes, when an intermediate transfer mixture of the above polyimide/untreated carbon black/alcohol phosphate/fluoropolymer mixture was selected.

The mechanical properties of the above prepared alcohol phosphate treated phosphate intermediate transfer belt were measured as illustrated herein resulting in a Young's modulus of about 8,500 MPa and a break strength of about 237 MPa.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer member comprising a polyimide and carbon black that includes at least one chemically bonded alcohol phosphate ad wherein said alcohol phosphate is comprised of a mixture of $$C_8H_{17}—O—P(=O)(OH)_2$$

and $$C_{10}H_{21}—O—P(=O)(OH)_2$$

wherein said chemically bonded alcohol phosphate has a chemical bond that is ionic.

2. An intermediate transfer member in accordance with claim 1 further including a leveling agent of a polysiloxane, a fluoropolymer, or mixtures thereof.

3. An intermediate transfer member in accordance with claim 1 wherein that said alcohol phosphate is chemically bonded to said carbon black was determined by X-ray photospectroscopy analysis, and wherein at least one ionic bond, up to a multiplicity of bonds, formed between the carbon black and the alcohol phosphate is numbered from one to about 50.

4. An intermediate transfer member in accordance with claim 1 wherein said alcohol phosphate that includes at least one carbon black chemically bonded thereto is present in an amount of from about 0.1 to about 20 weight percent of total solids and wherein said chemically bonded alcohol phosphate has a chemical bond that is ionic.

5. An intermediate transfer member in accordance with claim 1 wherein said alcohol phosphate that includes at least one carbon black chemically bonded thereto is present in an amount of from about 0.5 to about 10 weight percent of total solids.

6. An intermediate transfer member in accordance with claim 1 wherein said polyimide is represented by at least one of the following formulas/structures

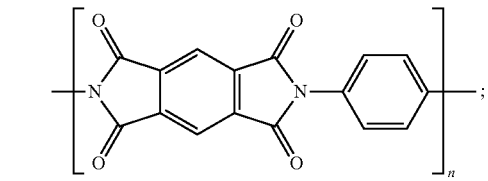

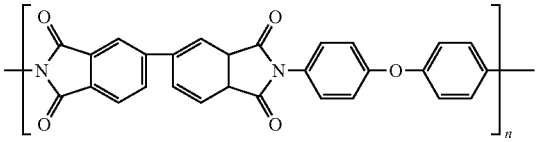

and

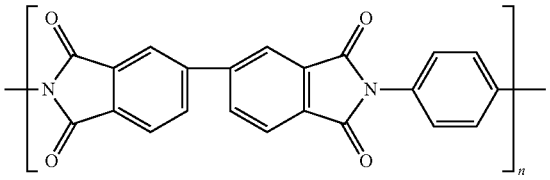

wherein n represents the number of repeating segments of from about 20 to about 200 and wherein said chemically bonded is ionic.

7. An intermediate transfer member in accordance with claim 1 wherein said polyimide as represented by the following formulas/structures

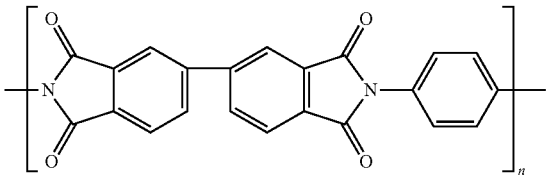

wherein n is about 30.

8. An intermediate transfer member in accordance with claim 1 with a Young's modulus of from about 4,000 to about 10,000 MPa, and wherein said member self-releases from a supporting substrate of a metal subsequent to being deposited on said metal, and optionally which self-release is accomplished in from about 1 to about 10 seconds.

9. An intermediate transfer member comprising in sequence a supporting substrate, a layer thereover comprised of a mixture of a polyimide and carbon black that includes at least one ionically bonded alcohol phosphate, an optional polysiloxane, an optional fluoro polymer, or mixtures thereof wherein said alcohol phosphate is represented by at least one of the following formulas/structures $C_6H_{13}$—O—P(=O)$(OH)_2$, $C_6H_{11}$—O—P(=O)$(OH)_2$, $C_{12}H_{25}$—O—P(=O)$(OH)_2$, $C_{12}H_{23}$—O—P(=O)$(OH)_2$, $C_{16}H_{33}$—O—P(=O)$(OH)_2$, $C_{16}H_{31}$—O—P(=O)$(OH)_2$, $C_{13}H_{27}$—O—P(=O)$(OH)_2$, $C_{13}H_{35}$—O—P(=O)$(OH)_2$, and $C_{8\text{-}10}H_{17\text{-}21}$—O—P(=O)$(OH)_2$.

10. An intermediate transfer member in accordance with claim 9 wherein said member possesses a Young's modulus of from about 5,000 to about 9,000 MPa.

11. A composition comprised of a polymer and a carbon black that includes at least one chemically bonded alcohol phosphate and wherein said alcohol phosphate is comprised of a mixture of $C_8H_{17}$—O—P(=O)$(OH)_2$ and $C_{10}H_{21}$—O—P(=O)$(OH)_2$.

12. A composition in accordance with claim 11 wherein said chemically bonded is ionic.

13. A composition in accordance with claim 11 further including a leveling agent of a polysiloxane, a fluoro polymer, or mixtures thereof and wherein said polysiloxane is optionally selected from the group consisting of a polyester modified polydimethylsiloxane, a polyether modified polydimethylsiloxane, a polyacrylate modified polydimethylsiloxane, and a polyester polyether modified polydimethylsiloxane.

14. A composition in accordance with claim 11 wherein that said alcohol phosphate is chemically bonded to said carbon black is determined by X-ray photospectroscopy analysis, wherein at least one ionic bond, up to a multiplicity of bonds, formed between the carbon black and the alcohol phosphate is numbered from one to about 50 and wherein said chemically bonded is ionic.

* * * * *